US009068785B2

(12) United States Patent
Ball

(10) Patent No.: US 9,068,785 B2
(45) Date of Patent: Jun. 30, 2015

(54) ILLUMINATED CHAMBER STATUS INDICATOR

(76) Inventor: Michael Leroy Ball, Madera, CA (US)

( * ) Notice: Subject to any disclaimer, the term of this patent is extended or adjusted under 35 U.S.C. 154(b) by 0 days.

(21) Appl. No.: 13/396,431

(22) Filed: Feb. 14, 2012

(65) Prior Publication Data

US 2012/0297655 A1 Nov. 29, 2012

Related U.S. Application Data

(60) Provisional application No. 61/443,060, filed on Feb. 15, 2011.

(51) Int. Cl.
*F41A 9/53* (2006.01)

(52) U.S. Cl.
CPC ..... *F41A 9/53* (2013.01)

(58) Field of Classification Search
CPC ..... F41A 9/53
USPC ..... 42/1.01, 1.02, 1.03, 1.04, 1.05, 46
See application file for complete search history.

(56) References Cited

U.S. PATENT DOCUMENTS

| | | | | | |
|---|---|---|---|---|---|
| 1,992,934 | A * | 3/1935 | Bamberger | 42/1.05 |
| 2,134,406 | A * | 10/1938 | Jacobs | 42/1.01 |
| 3,024,453 | A * | 3/1962 | Ransom | 89/14.05 |
| 3,342,743 | A * | 9/1967 | Rosenberg | 252/646 |
| 4,020,203 | A * | 4/1977 | Thuler | 250/458.1 |
| 4,100,691 | A * | 7/1978 | Wicklund | 42/1.05 |
| 4,539,889 | A | 9/1985 | Glock | |
| 4,697,366 | A * | 10/1987 | Frisoli | 42/1.05 |
| 5,005,307 | A * | 4/1991 | Horne et al. | 42/1.02 |
| 5,052,139 | A * | 10/1991 | Marzocco | 42/1.05 |
| 5,065,519 | A * | 11/1991 | Bindon | 42/145 |
| 5,359,800 | A * | 11/1994 | Fisher et al. | 42/145 |
| 5,410,831 | A | 5/1995 | Felk | |
| 5,926,987 | A | 7/1999 | Novak | |
| 6,072,400 | A * | 6/2000 | Johnson et al. | 340/691.1 |
| 6,094,850 | A | 8/2000 | Villani | |
| 6,250,008 | B1 * | 6/2001 | Silver | 42/70.01 |
| 6,256,915 | B1 | 7/2001 | Da Silveira | |
| 6,432,559 | B1 * | 8/2002 | Tompkins et al. | 428/624 |
| 6,510,641 | B1 * | 1/2003 | Viani | 42/70.08 |
| 6,622,411 | B2 | 9/2003 | Liebenberg | |
| 6,681,676 | B2 * | 1/2004 | Hayes et al. | 89/1.34 |
| 6,785,994 | B2 | 9/2004 | Christiansen | |
| 6,857,213 | B2 | 2/2005 | Fluhr | |
| 7,305,786 | B2 * | 12/2007 | McGarry | 42/1.05 |
| 8,109,023 | B2 | 2/2012 | Pikienly | |
| 2005/0016048 | A1 * | 1/2005 | Fluhr | 42/1.05 |
| 2005/0229458 | A1 * | 10/2005 | McGarry | 42/1.05 |
| 2010/0088944 | A1 * | 4/2010 | Callihan | 42/145 |

* cited by examiner

*Primary Examiner* — Bret Hayes
(74) *Attorney, Agent, or Firm* — Craig R. Miles; CR Miles P.C.

(57) ABSTRACT

A chamber status indicator for a firearm such as a handgun, rifle, or shotgun is disclosed. The chamber status indicator comprises a self-illuminating substance such as a gaseous tritium light source or self-illuminating paint, wherein light from the self-illuminating substance is visible only when a cartridge is loaded in the chamber. The self-illuminating substance can be mounted in a mechanical chamber status indicator. The self-illuminating substance can be mounted in a wall of the chamber. The self-illuminating substance can be mounted in a cartridge extractor. The self-illuminating substance can be affixed to or integrated into a bolt, breech or slide of the firearm. The self-illuminating substance can be integrated into a cylinder containing multiple chambers.

1 Claim, 7 Drawing Sheets

FIG. 8 self-illuminating substance and holding framework

FIG. 9 Topwall of Chamber integration of ICSI

FIG. 10 Self-revealing ICSI (topwall chamber integration)

FIG. 11 ICSI framework shown holding tritium vials

FIG. 12 Handgun slide with chamber-loaded indicator showing

FIG. 13 Handgun slide with ICSI showing

FIG. 14 Extractor-CLI

ILLUMINATED CHAMBER STATUS INDICATOR

CROSS-REFERENCE TO RELATED APPLICATIONS

This application claims the benefit of Provisional Patent Application Ser. No. 61/443,060, filed 2011 Feb. 15 by the present inventor.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

SEQUENCE LISTING

Not applicable.

BACKGROUND OF THE INVENTION

The following is a tabulation of some prior art that presently appears relevant:

| Patent Number | File Date | U.S. Pat. Issue Date | Patentee |
|---|---|---|---|
| 5,410,831 | Aug. 22, 1994 | May 2, 1995 | Felk, Edward K. |
| 5,926,987 | Aug. 8, 1997 | Jul. 27, 1999 | Novak, Peter |
| 8,109,023 | Feb. 16, 2010 | Feb. 7, 2012 | Pikielny, Dov |
| 6,094,850 | May 24, 1996 | Aug. 1, 2000 | Villani, Michael J. |
| 6,256,915 | Dec. 28, 1999 | Jul. 10, 2001 | da Silveira, Nilton |
| 6,622,411 | Aug. 29, 2002 | Sep. 23, 2003 | Lienbenberg, Paul |
| 6,785,994 | Jun. 17, 2003 | Sep. 7, 2004 | Christiansen, Ned F. |
| 6,857,213 | Dec. 3, 2003 | Feb. 22, 2005 | Fluhr, Norbert |
| 4,539,889 | Dec. 30, 1982 | Sep. 10, 1985 | Clock, Gaston |

A chamber-loaded indicator is a device that indicates the presence of a cartridge in the chamber of a firearm. The status of a firearm, whereby the operational definition of status specifically relates to the state of the weapon being, loaded or unloaded is of great importance to the firearm operator. It is of utmost importance to the person(s) whose duty it is to carry a firearm on their person in the scope of their job. Military and law enforcement personnel are two specific examples of these types of individuals. The risk of not immediately knowing the status of the weapon can be lethal for the aforementioned groups, as combat readiness is a requisite of their job responsibilities. Moreover, within the course of these duties taking place irrespective of time of day; it is required that steps taken during daylight hours to verify the status of the weapon are repeatable where low-light to zero-light conditions exist. Instantaneous weapon status checks become of paramount importance for firearms operators when deployed into war, where split seconds can determine life or death for them.

To date there have been various attempts to provide weapon status indicators, specifically in the form of, "chamber loaded indicators." While all the current various chamber loaded indicators available on all different models of firearms attempt to fulfill their intended purpose; none of them were designed from inception to, nor allow for, the same visual confirmation steps taken in lighted conditions to be taken in low-light to zero-light conditions without the use of an external light source.

This has been the case primarily because all previously designed chamber loaded indicators were intended for use in the civilian market, where instantaneous visual weapon status confirmation in either day or night is not life-threatening, nor is needed. Unfortunately, the hours of operation for war or policing activities do not only take place between the hours of 8:00 am to 5:00 pm, or solely located on a shooting range.

Currently, all other chamber-loaded indicators rely on visual confirmation during lighted conditions, as well as providing a secondary status check capability in the form of tactile confirmation. However, as is most often the case both military and law enforcement personnel wear gloves within the scope of their work. This further limits the ability of all other chamber-loaded indicators to fulfill their intended purpose.

It is the case with all other chamber-loaded indicators, which claim a tactile form of weapon status confirmation as a secondary attribute, that the position of the chamber-loaded indicator mechanism itself to signal a state of loaded or unloaded is barely discernable with the naked hand. Therefore, this claimed tactile confirmation by all other chamber-loaded indicators is nearly impossible for those that do or must wear hand protection in the course of their work.

This barely discernable tactile confirmation by all other chamber-loaded indicators is quite common in all current existing designs. It is the case for firearms such as Springfield Armory's XD handgun including the XDm models, the difference in degrees by which the chamber-loaded indicator protrudes in loaded or unloaded state is minor, and is not quickly ascertainable either visually or tactilely. It is also the case for firearms manufacturer Beretta, their 92 series and the like. Firearms manufacturer Taurus who clones other manufacturers designs, not surprisingly exhibits this characteristic in their clones of Beretta's 92 series, and the like.

Firearms manufacturer Glock makes claims of their firearms being equipped with chamber-loaded indicator devices. However, their chamber-loaded indicator devices on all of their models are extremely difficult to confirm visually even in lighted conditions and would be virtually impossible to confirm if the operator's hands were covered with gloves.

All firearms manufacturers make it a key and primary claim the main reason for their chamber-loaded indicator is safety. The present invention considers one of its primary claims to improved chamber-loaded indicator creation as being one of increased versatility, specifically tactical practicality, with increased safety being a welcome secondary by-product.

Glock in fact added a chamber-loaded indicator to their line of handguns seemingly as an afterthought, and only starting with the 3$^{rd}$ generation of the same product line. Actually due to U.S. firearms importation laws, the Bureau of Alcohol, Tobacco, and Firearms point system, and importation eligibility requirements probably had more to do with Glock adding a chamber-loaded indicator to their firearms than did safety reasons. Examining the Glock chamber-loaded indicator, which is actually added-on to the extractor component in all their handguns reveals what seems to be more of a fortuitous coincidence of manufacturing angles that allowed this quick and workable add-on than purpose driven engineering.

There is a need in the art for the uniformity of both universal functionality and safety. Changing environmental conditions should not detrimentally impact the operational usability and safety of firearms as is currently the case. The present invention seeks to add an additional factor in helping to preserve the uniformity of both universal functionality and safety in a constantly changing environment.

FIELD OF INVENTION

This invention relates to firearms; handguns, rifles, and shotguns, and to the assemblies and sub-assemblies that comprise them as a whole, specifically the mechanism(s) in them which works in the capacity as a chamber status indicator. A chamber status indicator is also referred to in the firearms industry as, a chamber loaded indicator, in this document the terminology will be used interchangeably, unless otherwise specified. Furthermore, a chamber status indicator is most often claimed to be solely belonging to the semi-automatic handgun class of firearms. The present invention can, and has intent to be applied to all types, all classes of firearms.

OBJECT OF THE INVENTION

The objective of the invention is the creation of a self-illuminated chamber status indictor, or simply illuminated chamber status indicator (ICSI). The invention can and will leverage current illumination technologies that require no external power source in order to give off light emissions. The invention will look to use the properties of radioluminescence as a primary, but not exclusive source to create such attributes.

SUMMARY OF THE INVENTION

[Intro]

The invention can utilize radioluminescence technology. As a primary example it can employ the use of gaseous tritium light sources (GTLS), which is one type of radioluminescent material, the key ingredient being tritium as opposed to radium for example another radioluminescent material, although of lesser light emitting qualities.

[History-Tritium Use in Firearms]

The use of GTLS is currently an established standard for Radioluminescence technology in the firearms industry as it has been used for over two decades with proven superior functionality for its intended use. To date, the only currently known use of tritium in firearms components, assemblies, subassemblies, mechanism(s), and the like are its integration into firearms sights. The sights on any firearm contain a pair, both the front and the rear sight. These sights can contain tritium vials that are embedded into either or both sights.

[How this Relates]

The benefits of using tritium as a primary source of Radioluminescent material directly relates back to the objective of this invention.

Gaseous tritium light sources are;

Self-Illuminated

- Available in extremely tiny glass vials hermetically sealed, making them versatile as an embeddable component into an existing firearms assembly or mechanism such as a chamber loaded indicator, creating the new object, an ICSI
- Coated on the inside of the vial with phosphorescent material, which is available in different colors depending on preference and desired brightness level
- Filled with only trace amounts of tritium gas, making them virtually harmless
- Emitting electrons that activate the phosphorescent material permanently, without the need of external power, or even a charging catalyst
- Capable of having a life-span of at least 10 years, before the need to replace

[What it does]

This invention provides a never before conceived self-illuminated chamber status indicator (ICSI) utilizing GTLS. The GTLS is embedded into a chamber status indicator component and/or mechanism(s) creating the present invention called, the Illuminated Chamber Status Indicator (ICSI). The introduction of GTLS as an embedded component to the chamber status indicator mechanism creates a self illuminated chamber status indicator, or simply an illuminated chamber status indicator (ICSI). The ICSI, allows the operator of the firearm to check the status of the weapon, loaded or unloaded, in very low light to zero light conditions. The ICSI visually signals the presence of a live round of ammunition and/or cartridge, or shell casing only in the chamber of the firearm. The ICSI accomplishes this visual confirmation of weapon status (loaded), by exposing the self-illuminated part, specifically the tritium to the firearms operator. If the weapon status is unloaded, the ICSI, specifically the light being emitted from the tritium will not be visible to the firearms operator.

BRIEF DESCRIPTION OF THE DRAWINGS

The indicating device subject matter of the present invention will be best understood in the light of the following description, made in relation with the appended figures, that illustrate a preferred—not limiting—manner of production of the present invention, wherein.

DETAILED DESCRIPTION OF PREFERRED EMBODIMENT AND METHOD

[How it is Applied in Firearms]

The ICSI technology is designed to be, and can be applied universally to all makes and models of firearms. This encompasses handguns, rifles, and shotguns. Although these categories of firearms fulfill very different roles as well as have different external structures, they also share much of the same design of internal components.

[Existing Firearms—Common Design Features]

Categories of firearms relevant to the ICSI invention include the following;

- Handgun—semi-automatic, single shot, full automatic (select-fire), and revolver
- Rifle—semi-automatic, bolt action single shot, full automatic (select-fire)
- Shotgun—pump action, semi-automatic and full automatic (select-fire)

[Modern Firearm Ammunition—these Cartridge Components Will be Referred to Henceforth]

Cartridge based ammunition has been in popular use since the mid-1800s. Although the ICSI invention could be applied to non-modern firearms, it is the intent of the inventor to describe that which applies to modern day usage.

Figure 1:
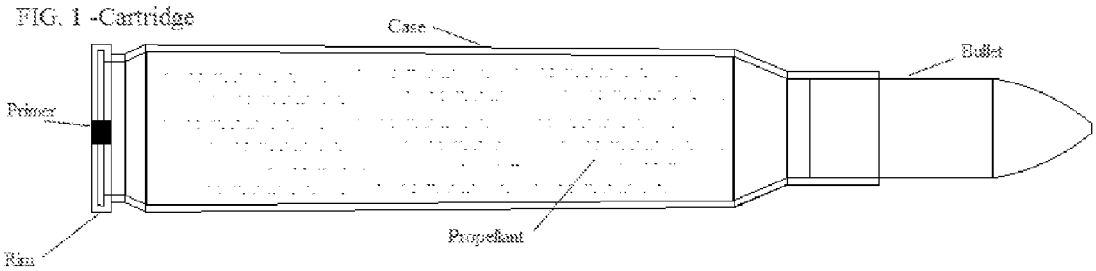
FIG. 1—is a side view of a Cartridge of ammunition, and all internal components FIG. 2—is a side view of the barrel assembly, with chamber and barrel tube FIG. 3—is a handgun slide side view FIG. 4—is a handgun extractor component FIG. 5—is a chamber FIG. 6—is a view of the top and side chamber walls of a barrel FIG. 7—is the illuminated chamber status embedded into chamber sidewalls FIG. 8—is an example of the illuminated chamber status indicator with framework FIG. 9—is an example of type of installation for ICSI into chamber, fulcrum displayed FIG. 10—is an example of type of installation for ICSI into chamber, reveal displayed FIG. 11—is an example of tritium vials being used in ICSI framework FIG. 12—is handgun slide with chamber loaded indicator showing FIG. 13—is handgun slide with ICSI showing FIG. 14—is a combination extractor-chamber loaded indicator (non-illuminated)

The modern cartridge fully assembled contains the following; FIG. 1

- case—which holds within it or attaches to all of the following;
- primer—contains impact sensitive explosive compounds
- propellant—In powder-form, ignited by primer
- bullet—the projectile that is forced out the barrel by propellant

[Existing Firearms—Common Components]

Figure 2:
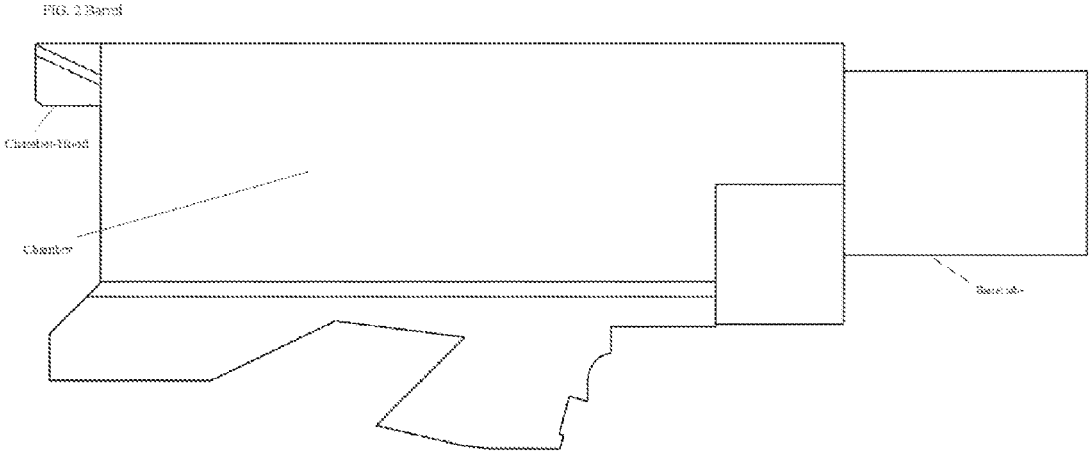

In each of the above categories of firearms they all have the following components in common; (this is not an all inclusive list, just components having most relevance to ICSI) FIG. 2

Figure 3:
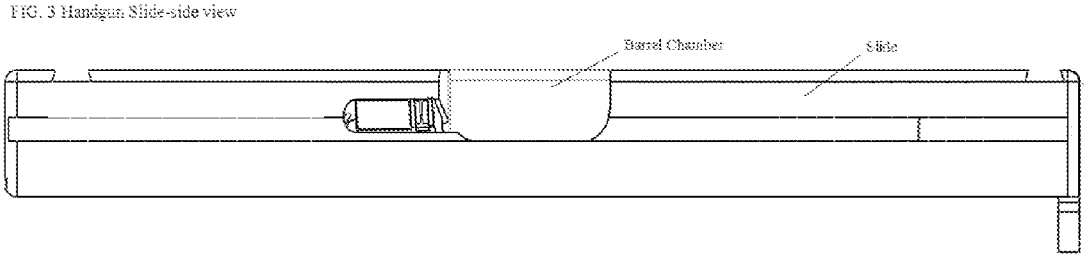
Figure 4:
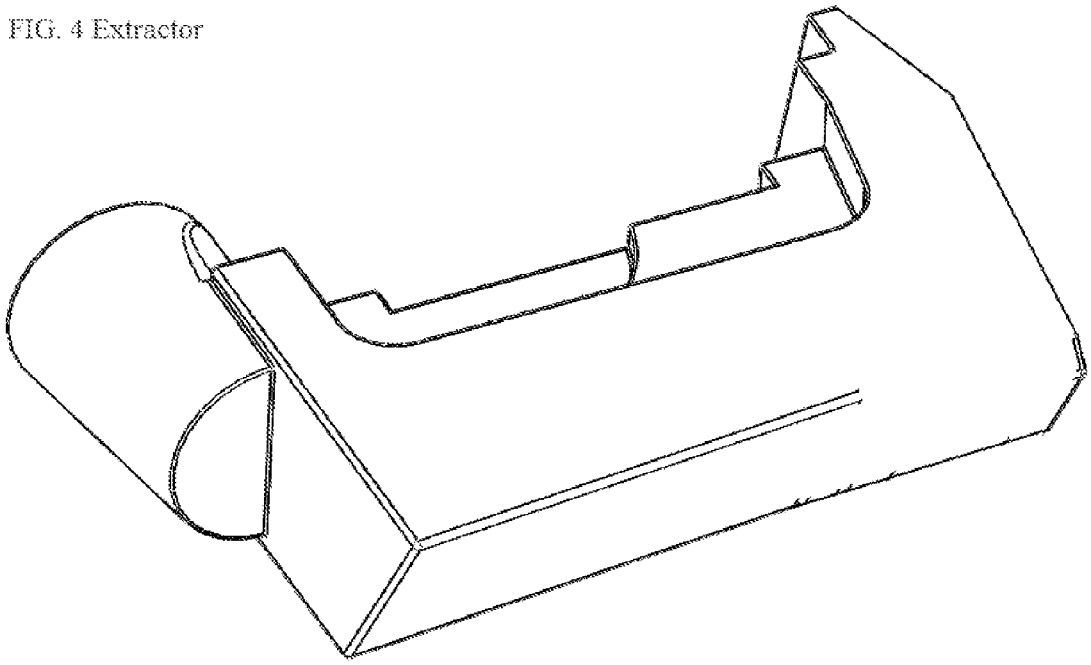

- Barrel—more specifically a chamber and barrel tube assembly, most commonly referred to as "the barrel", is one complete assembly with two distinct areas (excluding the revolver in this statement, its barrel & chamber are separate)
  - the chamber
    - this holds/supports a complete unfired cartridge of ammunition
    - it can also hold the spent shell casing of a fired cartridge
    - also referred to as the "barrel extension"
  - the barrel tube
    - this is the metal tube from which the bullet is projected
- Bolt (Breech or Slide)—this component constrains the cartridge within the chamber, effectively encapsulating it. This allows for extreme pressure to build upon cartridge ignition and the bullet projects out through the barrel. FIG. 3
- Extractor—this component is usually attached to the bolt assembly (revolvers excluded) and has a hook or claw that enables it to grab the rim of the cartridge when it is being loaded into the chamber. When the bolt (breech) opens, the extractor pulls and guides the fired cartridge case from the chamber, effectively removing the spent shell casing from the firearm completely. FIG. 4
  - There are different ways to design an extractor, this varies amongst firearms manufacturers. However, the purpose remains the exact same across all categories of firearms. The extractor works as a latch using spring tension. The extractor latches a hold of the rim of a cartridge when loading it into the chamber of the barrel, as well as retains its hold on the rim when ejecting the spent shell casing from that chamber.
  - Because the extractor is a moving part within a bolt (breech), its size, shape, and overall dimensions need to work in alignment with the overall firearm. Its internal dimensions must fit, specifically the claw/hook, must fit precisely to the caliber of cartridge it is intended to extract.
  - The external dimensions of the extractor can have considerable more leeway. Extra material may be added to the externals of the extractor and fashioned in such a way as to add an additional function to the extractor. This additional function can be for the extractor to act as a chamber loaded indicator, in addition to fulfilling its primary function. As an example, the manufacturers; Glock and Beretta have used this type of design, a combination extractor and chamber loaded indicator.

[Illuminated Chamber Status Indicator—Areas of Installation into Existing Firearm Mechanism(s) and Common Components]

ICSI technology could be integrated into existing firearms mechanism(s) including all; components, assemblies and sub-assemblies. The following are examples of potential integration points into the firearm. This is not an all inclusive list. It is a demonstrative list using the aforementioned components from the previous section. However, using these existing components is in fact the most direct way to apply the ICSI invention to a firearm.

Figure 5:
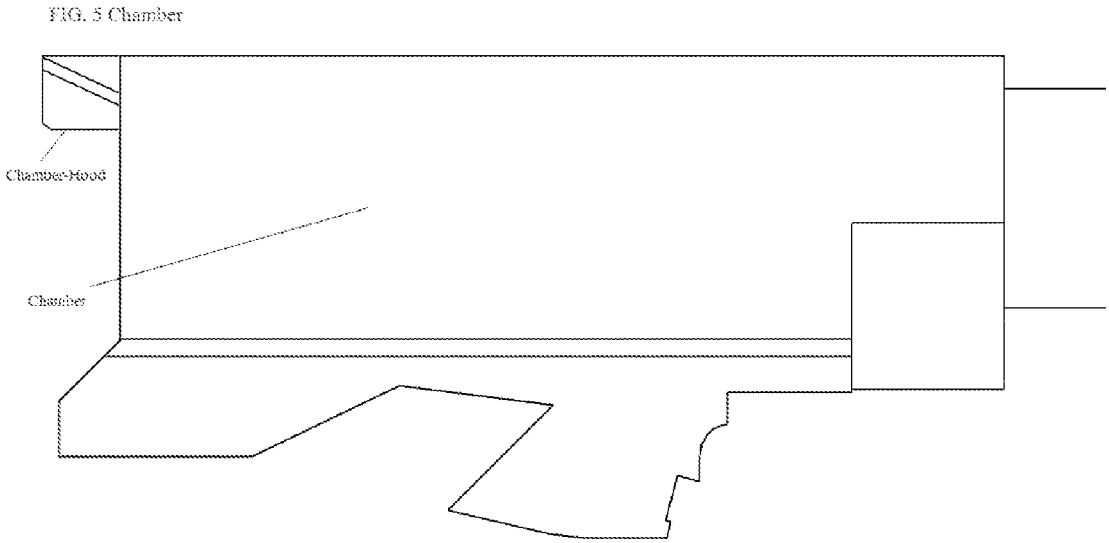

- Chamber—this is a key component for application of the ICSI invention. FIG. 5

The chamber completely encapsulates the cartridge of live unfired ammunition from all sides. The internal dimensions of the chamber are in fact the same as that of the caliber of cartridge it is intended to fire. The chamber by default is constructed of thicker metal than that of the barrel tube, hence why it is referred to also as the barrel extension. It is a contiguous part of the barrel tube; however, externally its dimensions can be completely different. This difference relates back to the overall design of the firearm. The chamber's thickness is constructed in this manner due to the excessive pressures that are exerted within and upon it during ignition of the cartridge. It is because the chamber walls are thicker that slight external/internal modifications to these walls can be accomplished without adversely affecting the main function of the chamber. Creating these modifications to the external/internal walls of the chamber can and, (in the case of ICSI integration being the reason for these modifications), will create new functionality from the chamber.

[Integration Specifics—ICSI Case Scenarios of the Technology Applied to the Chamber]

The cases below are not an all inclusive list of the many ways in which the ICSI invention could be applied to a firearm chamber. They are instead meant to be representative of the most direct way to make use of ICSI technology in modern firearms designs.

[ICSI Chamber Integration]

This first example will consider and explain modifications to a handgun barrel, specifically the chamber. However, this does not exclude the same premise from being applied to that of all other chambers across all categories of firearms listed previously. Currently all chambers of all type of firearms do not have a chamber loaded indicator that completely resides as part of the chamber portion of the barrel. What is described below is to be considered an example as well as an intended construct by which to implement the ICSI invention. The modification path is described below. However, newly designed barrels around ICSI technology is well within the reality of metal design, machining and fabrication.

[ICSI—Moveable Framework]

Figure 6:
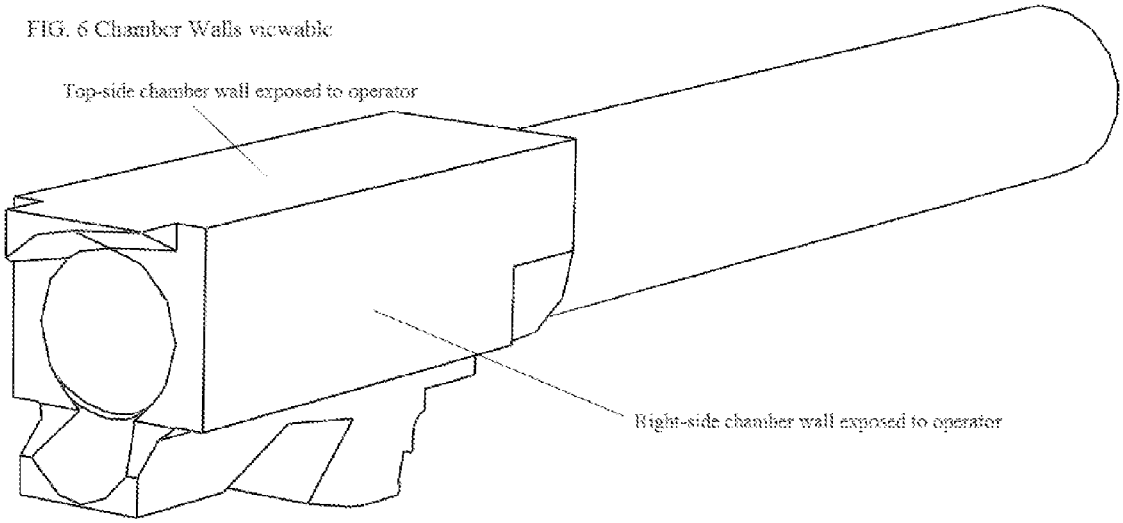

The ICSI can be machined as a moveable component that resides within the top or the sidewalls of the chamber. These are the only viewable surfaces of the chamber by the firearm operator, once the barrel is installed in the firearm. FIG. 6

[ICSI—Areas of Chamber Integration]

ICSI—sidewall chamber integration

Figure 7:
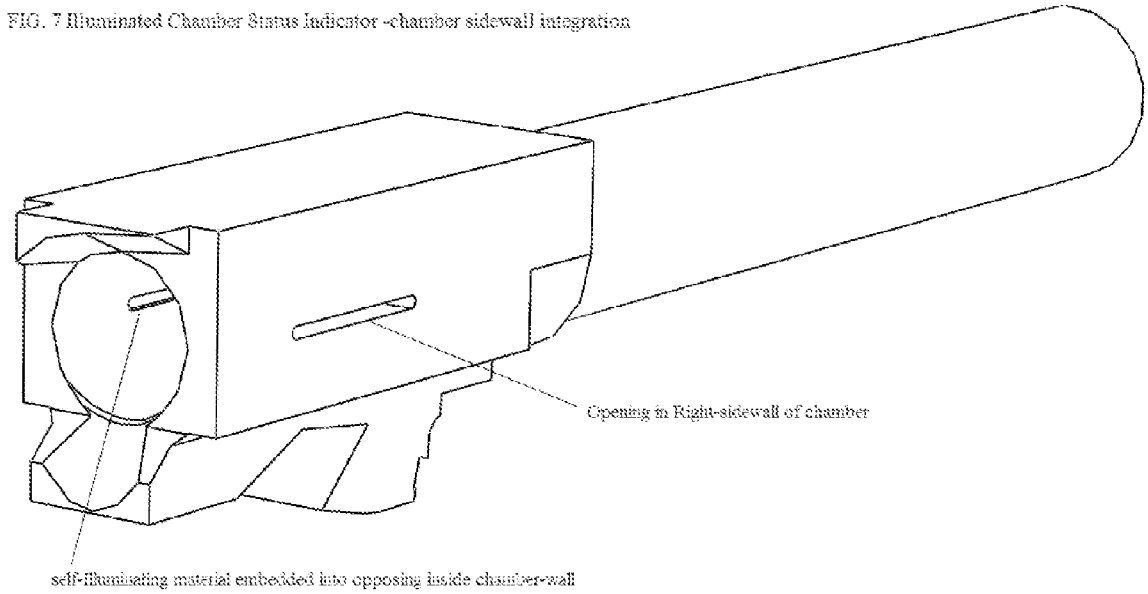

ICSI integration into the side wall requires it to be specifically the right hand side of the chamber wall (chamber opening toward the operator, muzzle or open end of the barrel facing away). The right sidewall is clear from the Bolt (Breech) or in the case of a handgun the slide, thereby allowing visual confirmation of the ICSI by the firearms operator. The left-hand and bottom-side chamber walls are completely covered by the left-hand sidewall of the slide and firearm-frame, respectively and remain non-visible until the barrel, slide, and firearm-frame are separated. FIG. 7

ICSI—top-wall chamber integration

ICSI integration into the top-wall of the chamber requires only integration of the ICSI component, irrespective of the slide assembly orientation.

[ICSI—Component Makeup (Required if not Integrated into Existing Components)]

Figure 8:
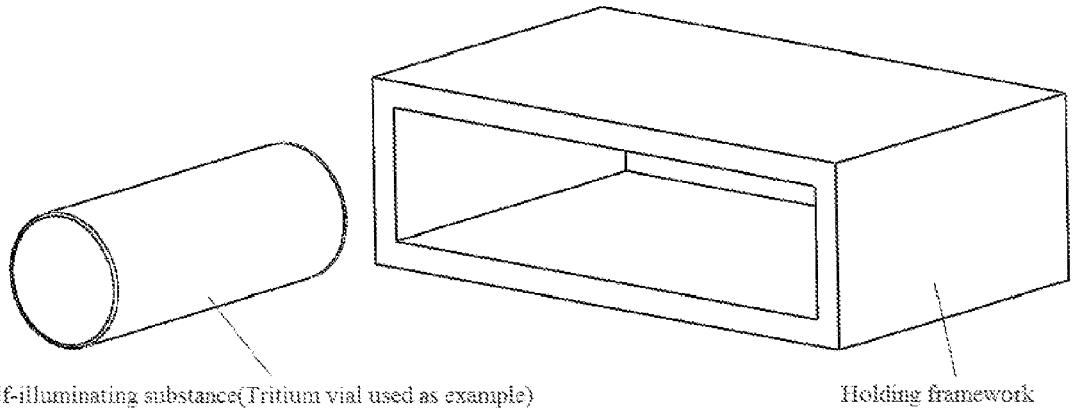

ICSI primarily, but not exclusively, contains as a minimum structural requirement a material by which to frame the tritium vial(s) (as an example of an illuminating material). This ICSI-frame must keep the tritium vial secure and immovable, irrespective of the motion of the overall ICSI-frame itself. The tritium vial(s) contained within the ICSI-frame must be allowed to be viewable from a desired angle. Installation parameters of the ICSI component will define the angle and appropriate amount of exposure the tritium vial will have from within the ICSI-frame. The material of the ICSI-frame itself will most likely be composed of some form of metal, with the durability and hardness similar to other metal components within the overall firearm. FIG. 8

[ICSI—Method of Function (ICSI Frame is Dynamic)]

Figure 9:
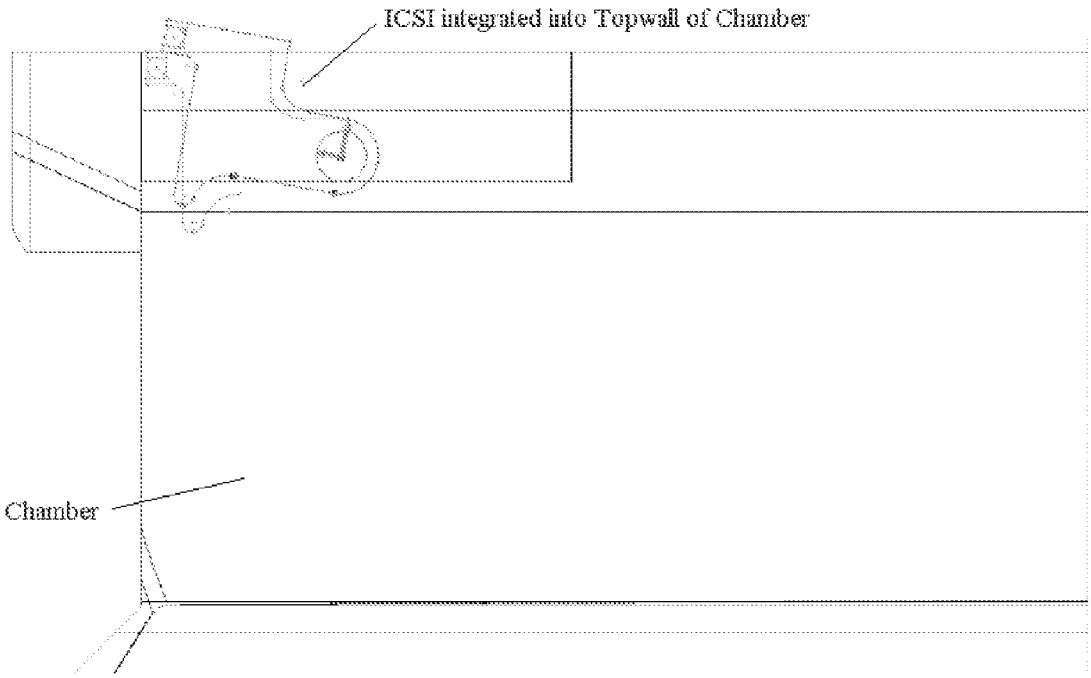

ICSI must actuate/move, (becoming visible and non-visible), by reacting to the loaded or unloaded condition of the barrel's chamber. The ICSI, to complete this task must be partially located in the chamber, as well having the ability of protruding out from the top or the sidewall of the chamber. The ICSI must then by definition be able to make contact with a cartridge introduced into the chamber, yet not obstruct its path toward correct seating within the chamber. The ICSI in fact will; react, actuate, and function within the thickness of the chamber's walls. The ICSI will have presence within the chamber-cartridge space, within the chamber walls, and just outside the surface of the chamber walls. FIG. 9

[ICSI—Mechanism(s) of Movement, ICSI Moveable Frame]

ICSI must have as a required structural component of movement a subcomponent that both prohibits and allows movement in the appropriate direction. A chamber loaded with a live cartridge would necessitate that the ICSI moves outward protruding to the top or sidewall of the chamber as a result of the ICSI's interaction with specifically the case of the cartridge. The ICSI's protruding structure would then display the tritium to the firearm's operator revealing the status of the chamber.

[ICSI—Mechanism(s) of Movement Specific Device Examples, ICSI Moveable Frame]

Figure 10:
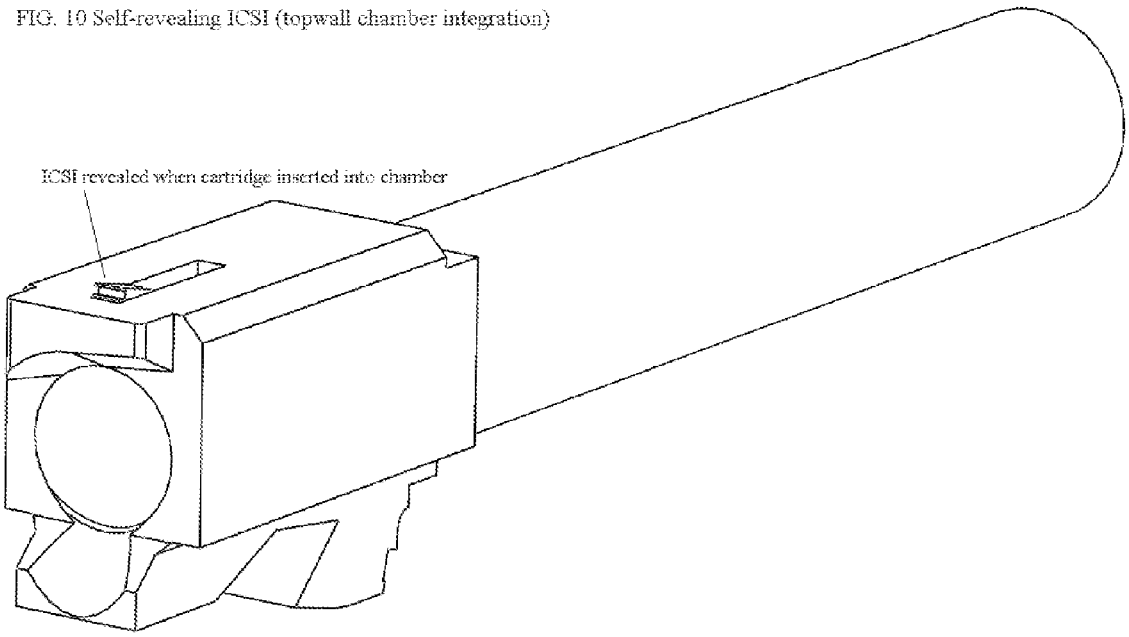

ICSI could use any of those following device(s) as a subcomponent(s) individually or in tandem to facilitate movement in and around the chamber:

fulcrum—whereby the entire ICSI frame pivots in and about the chamber wall from the pivot point of a roll-pin attaching to the ICSI framework as well as the chamber itself, using spring tension to counterbalance movement facilitated by cartridge insertion into the chamber.
example 1=pivot-point configuration FIG. 9
example 2=self-revealing configuration FIG. 10 compressed spring(s)—spring(s) are held in place via mounting tension of the ICSI frame and mounting grooves in the chamber walls. Essentially the ICSI frame is suspended via spring(s). Springs would compress reacting to pressure being facilitated by the insertion of cartridges and ejecting of empty shell cases. ICSI frame would move from a state of protrusion from the outer chamber wall (loaded), to a state of flush with outer chamber wall (unloaded). Conversely, when the chamber was in an unloaded state, the ICSI frame would protrude into the chamber space area, since no cartridge would be applying upward or outward force to it.

[ICSI—Mechanism(s) of Movement, ICSI Non-Moveable Frame]

assisted articulation—a simple mechanical structure that is commonly employed. This integration method would require the entire ICSI-frame containing the tritium vial(s) to remain immovable, embedded at the appropriate location on a chamber wall surface. ICSI visibility would be controlled by a "covering component" whose function it is to move over the visible area containing the tritium. This covering component would slide back and forth in such a way as to expose or hide the tritium, depending on this mechanisms interaction with the cartridge. A cartridge inserted into the chamber actuates the covering component to slide in a manner which reveals the tritium. When the condition of the chamber is empty, the covering component returns to its default position of covering the tritium. FIG. 10

[ICSI—Non-Moveable Frame, Meaning of Visible Tritium Reversed, Rare Installation]

Embedded into internal chamber wall—ICSI frame embedded horizontally directly into the left inner chamber wall (wall opposite the chamber wall closest to breech), when barrel opening is facing away from operator. Right chamber wall contains a horizontal opening, (exact dimensions dependent upon; firearm type, cartridge caliber, chamber size et. al.), at least the same length as the ICSI frame or tritium vial alone contained within the left inner chamber wall. The placement of the ICSI into the left inner chamber wall is in alignment with the opening on the right chamber wall. Right chamber wall opening allows visibility through the right chamber wall across the empty chamber space to the left inner chamber wall. ICSI visibility is obtained by operator looking through right side chamber wall opening. When ICSI is visible, no cartridge exists in the chamber, signifying an unloaded firearm. Conversely, when the ICSI is not visible, a cartridge exists in the chamber, signifying a loaded firearm. FIG. 7

[ICSI Case Scenarios of the Technology Applied to the Bolt (Breech)/Slide-Overview]

The cases below are not an all inclusive list of the many ways in which the ICSI invention could be applied to a firearm bolt (breech). They are instead meant to be representative of the most direct way to make use of ICSI technology in modern firearms designs. The example below will use the bolt (breech) of a handgun for demonstrative purposes. The bolt (breech), in the handgun category of firearms is referred to as the slide. These terms; bolt (breech) and slide will be used interchangeably in the following examples.

[Illuminated Chamber Status Indicator (ICSI) vs. Chamber Loaded Indicator]

*Note: In this section of the summary 'only', when referring to the preexisting older, "state of chamber technology", that is non-illuminated, (that which is not the ICSI), it will be referred to as a chamber loaded indicator for clear delineation apparent in the following sections entitled:

ICSI main structural differences to the Chamber Loaded Indicator

ICSI bolt (breech)/slide integration with chamber loaded indicator technology

Slide mounted chamber loaded indicator—mechanics of operation

ICSI integration specifics—slide mounted chamber loaded indicator

[ICSI Main Structural Differences to the Chamber Loaded Indicator]

Both devices indicate the presence of a cartridge in the chamber.

The chamber loaded indicators currently being installed into firearms are:

made from a solid piece of metal

Figure 11:
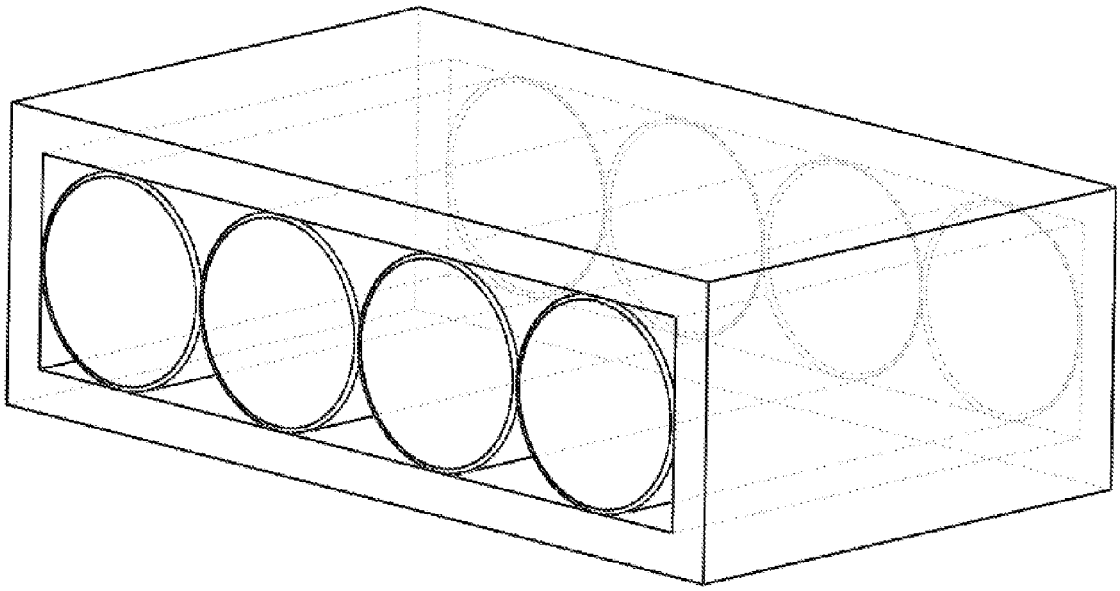

Spring or other tensioning device providing opposite force to rim a single component The illuminated chamber status indicator (ICSI) is (prior to installation): FIG. 11 a holding frame of either of the following;

metal-type dependent upon install destination

—or— high impact polymer e.g. (Nylon 6)

gaseous tritium light source or other self-illuminating substance containment vial for GTLS e.g. (glass, acrylic, transparent polymer)

NOA61 optical adhesive base (install destination dependent)

Spring or other tensioning device providing opposite force to rim considered an assembly or mechanism

[ICSI Bolt (Breech)/Slide Integration—with Chamber Loaded Indicator Technology]

This example describes ICSI integration of a handgun with an existing chamber loaded indicator. Currently not all bolt (breech)/slides of all type of firearms contain a chamber loaded indicator. The component called a chamber loaded indicator is utilized exclusively in the handgun category of firearms. Illuminated chamber status indicator (ICSI) technology can to be integrated into non-illuminated chamber loaded indicator components that are currently mounted to the slides of some handguns.

[Slide Mounted Chamber Loaded Indicator—Mechanics of Operation]

Figure 12:
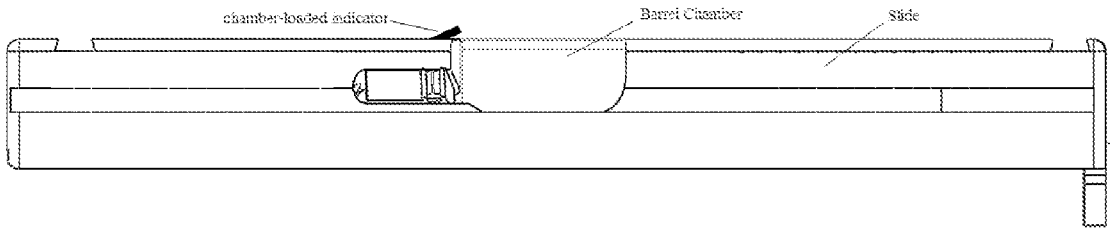

The slide mounted chamber loaded indicator resides along the top of the slide in modern semi-automatic handguns. It could also be located in different areas on the slide, depending on its proximity to the barrel chamber. It is typically located on the breech face opening of the slide where the rear most part of the barrel chamber makes contact. This rear most portion of the barrel chamber is referred to as the barrel-hood. It is necessary for the slide mounted chamber loaded indicator to have access to the rim of the cartridge as it is loaded into the chamber. It does not attach to the barrel in any way. The component itself therefore overlaps into the barrel-hood. It must do so in order to latch onto the rim and protrude, (signaling a chamber loaded state), from a near-flush position on the slide and overlap. FIG. 12

[ICSI Integration Specifics—Slide Mounted Chamber Loaded Indicator]

One main component of ICSI technology is the use of gaseous tritium light sources (GTLS). ICSI technology makes use of GTLS material within its framework.

Figure 13:
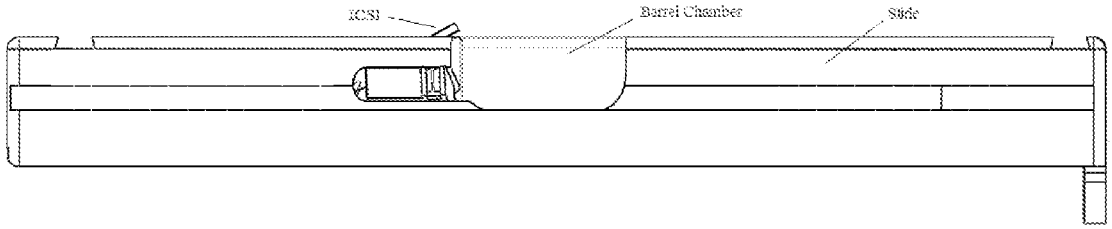

Integration method 1—GTLS by itself in some cases can be integrated into an existing slide mounted chamber loaded indicator component. This can in effect create the illuminated chamber status indicator. This integration can only be accomplished if the existing slide mounted chamber loaded indicator component's physical dimensions allow for modification(s), and acceptance of the GTLS within those newly modified dimensions. FIG. 13

Integration method 2—an alternative means for integration of ICSI technology is to create a new illuminated chamber status indicator assembly for handguns with pre-existing chamber loaded indicators. The ICSI assembly could have the same external dimensions of the original chamber loaded indicator component and therefore be a direct replacement. FIG. 13

Integration method 3—all other categories of firearms that are currently without a chamber loaded indicator, would require a completely newly designed ICSI assembly or mechanism(s), in order to function as an illuminated chamber status indicator.

[ICSI Integration Overview—Combination Extractor and Chamber Loaded Indicator]

The cases below are not an all inclusive list of the many ways in which the ICSI invention could be applied to a firearm combination extractor/chamber loaded indicator component. Henceforth, reference to the combination extractor/chamber loaded indicator component will be referred to as the extractor-CLI. The following example(s) are instead meant to be representative of the most direct way to make use of ICSI technology in modern firearms designs. The extractor-CLI is mainly a component used in the handgun category of modern firearms. However, the extractor-CLI component is not restricted to use solely in handguns, and can easily be applied to all other categories of firearms. The exception to this is the revolver class of handguns, as this type of firearm does not have an exposed extractor component. The example(s) below will use the extractor-CLI of a semi-automatic handgun for demonstrative purposes. The extractor-CLI component on a semi-automatic handgun is exposed and can be integrated with the ICSI assembly. The extractor-CLI component on a semi-automatic handgun could also be entirely replaced with an ICSI extractor assembly.

Figure 14:
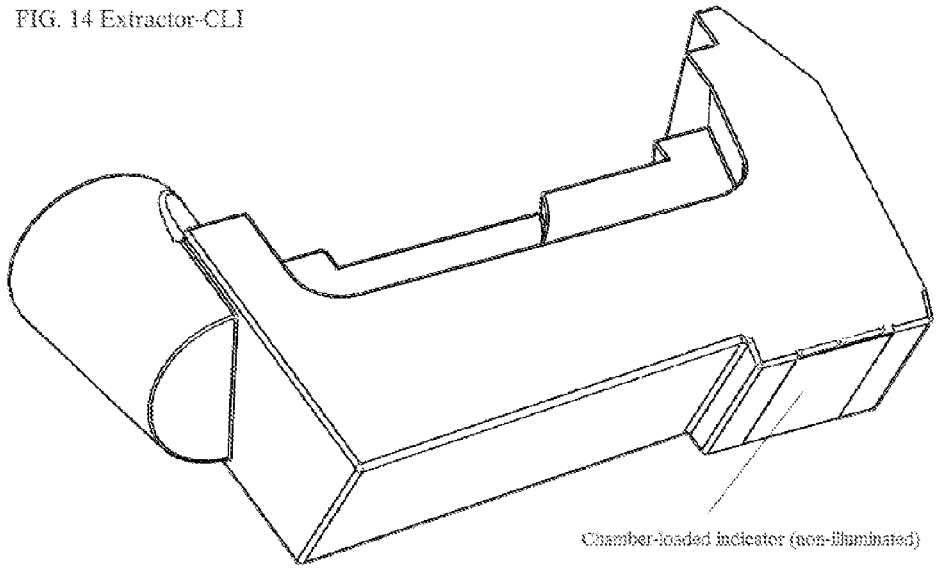

[Extractor-CLI Component Structural Specifics] FIG. 14

The extractor-CLI components currently being installed into firearms (handguns) are:

made from a solid piece of metal primary function is to be an extractor component CLI functionality via addition of uniquely shaped metal a single component

Figure 15:
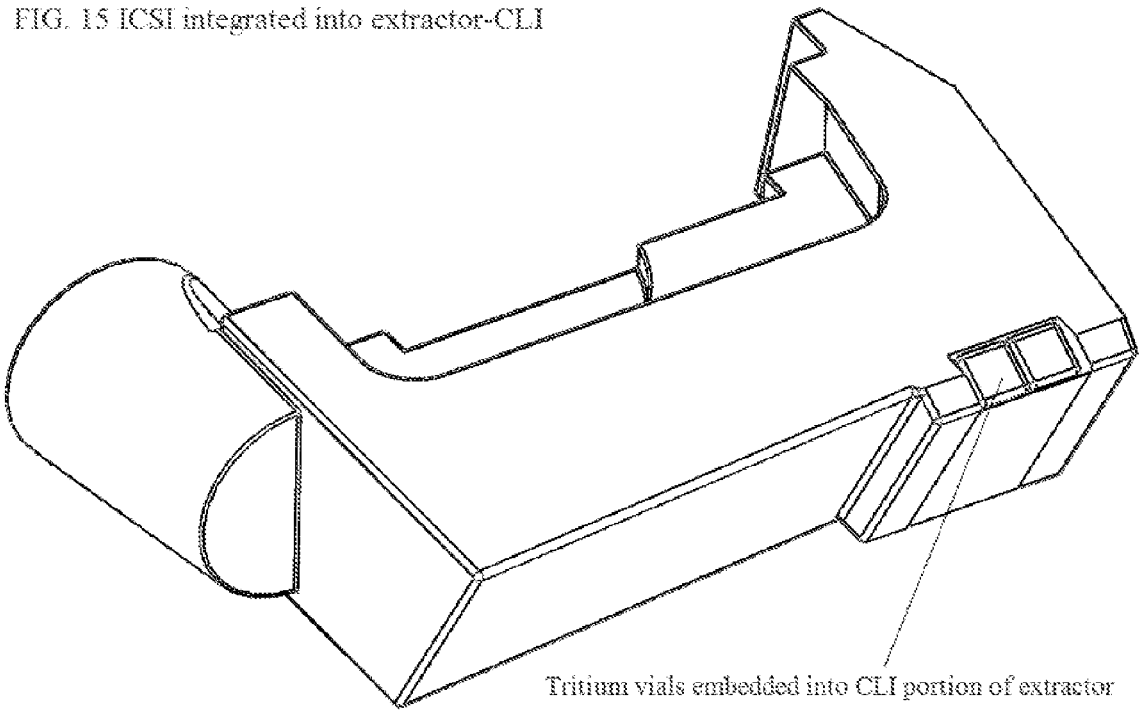
FIG. 15—is the ICSI integrated into an extractor-chamber loaded indicator

[ICSI Integration—with Extractor CLI Component] FIG. 15

This example describes ICSI integration into a handgun with an existing extractor-CLI component. Currently not all handgun extractors contain an integrated chamber loaded indicator. Specifically, most firearms extractors are not in extractor-CLI form. Illuminated chamber status indicator (ICSI) technology can be integrated into extractor-CLI components that are currently installed in some handguns. It can also be integrated into the majority of other firearms with intent to modify their existing extractor component into an extractor-CLI component, since extractor components across all firearms types are extremely similar.

[Extractor-CLI Component—Mechanics of Operation]

The extractor-CLI component resides as a free-floating component within the slide in modern semi-automatic handguns. Different styles of handguns have it located in different areas on the slide; however its close proximity to the barrel chamber is always required. The extractor-CLI component is typically located adjacent the breech face opening of the slide where the rear most part of the barrel chamber makes contact. It is necessary for the extractor-CLI component to have access to the rim of the cartridge as it is loaded into the chamber. It must have this contact with the cartridge in order to both function as an extractor, as well as a chamber loaded indicator. The extractor-CLI component must latch onto the rim of the cartridge and protrude, (signaling a chamber loaded state), from a flush to countersunk position on the slide. The extractor-CLI component does not attach to the barrel in any way. The extractor-CLI component does not overlap into the barrel chamber.

[ICSI Integration Specifics—with Extractor-CLI Component] FIG. 15

One main component of the ICSI assembly is the use of gaseous tritium light sources (GTLS). The ICSI assembly makes use of GTLS material within its framework.

Integration method 1—GTLS by itself in some cases can be integrated into an existing extractor-CLI component. This can in effect create an illuminated chamber status indicator (ICSI) assembly. This integration can only be accomplished if the existing extractor-CLI component's physical dimensions allow for modification(s), and acceptance of the GTLS within those newly modified dimensions.

Integration method 2—an alternative means for installation of the ICSI assembly is to create a new illuminated chamber status indicator assembly for handguns with pre-existing extractor-CLI components. The ICSI assembly could have the same external dimensions of the original extractor-CLI component and therefore be a direct replacement.

[Revolver—Modern Structural Overview]

A Revolver is a repeating firearm that has a cylinder assembly containing multiple chambers. It works by having this cylindrical assembly that are brought in alignment with the firing mechanism and barrel one at a time.

[Revolver—ICSI Structural Integration Challenges]

The ICSI assembly integration for the revolver class of handguns requires its own section of explanation. The ICSI assembly cannot be integrated into the revolver in the same manner as the semi-automatic handgun. This is due to the physical absence of some components, assemblies and/or mechanism(s), which are present in semi-automatics as well as different structural operating dynamics.

[Revolver—ICSI List of Integration Challenges]

Here is a list of specific structural integration challenges to the revolver class of handgun;

lack of an external free-floating extractor lack of existing excess extractor material with which to make modifications an extractor which cannot be visually observed from the exterior of the firearm an extractor that is one component comprised of many replicated extractor points an extractor mechanism in a wheel-shape design, that functions with rotary movement, even when not extracting an extractor mechanism that does not immediately remove a spent shell casing from the chamber, before firing the next cartridge a chamber that functions using rotary movement during its actuation a chamber that moves to another physical location about the handgun itself, after each actuation a chamber that moves out of visual line of sight with each actuation a cylinder assembly that contains multiple chambers

[Revolver—ICSI Integration into Cylinder]

The ICSI assembly can be integrated into the cylinder assembly of the revolver. The following example is one method that can be used.

assisted articulation—a simple mechanical structure that is commonly employed. This integration method would require the entire ICSI-frame containing the tritium vial(s) to remain immovable, embedded at the appropriate location on a chamber wall surface. ICSI visibility would be controlled by a "covering component" whose function it is to move over the visible area containing the tritium. This covering component would slide back and forth in such a way as to expose or hide the tritium, depending on this mechanisms interaction with the cartridge. A cartridge inserted into the chamber actuates the covering component to slide in a manner which reveals the tritium. When the condition of the chamber is empty, the covering component returns to its default position of covering the tritium.

[Advantages—the Following are Only a List of Additional Advantages of ICSI Technology]

The following are only some of the advantages of the ICSI technology. ICSI technology is designed to be, and can be applied universally to all makes and models of firearms. This encompasses handguns, rifles, and shotguns. Although these categories of firearms fulfill very different roles as well as have different external structures, they also share much of the same design of internal components.

This shared commonality will allow for the following advantages;

Ease of introduction and acceptability into the firearms market

Ease of adaptability into existing firearms designs

Ease of suitability across multiple firearms categories

Ease of installation by even the firearms operator in some cases (see Glock)

Ease of troubleshooting if ICSI mechanism were to fail

What is claimed is:

1. A firearm chamber status indicator comprising:

a chamber adapted to receive a cartridge;

a bolt which constrains a cartridge in said chamber;

an extractor pivotally disposed in said bolt, said extractor responsive to said cartridge received within said chamber to protrude outward of an external surface of said bolt;

a frame disposed in said extractor; and, a container secured by said frame, said container enclosing a light emitting element which emits an amount of light, said amount of light emitted by said light emitting element visible only when said extractor protrudes outward of said external surface of said bolt in response to said cartridge in said chamber.

* * * * *